US005183979A

United States Patent [19]

Sheridan et al.

[11] Patent Number: 5,183,979

[45] Date of Patent: Feb. 2, 1993

[54] ELEVATOR GOVERNOR ROPE RESTRAINT WHEN ELEVATOR CAR MOVES WITH CAR DOORS OPEN

[75] Inventors: William G. Sheridan, Southington, Conn.; Edward D. Reiskin, New York, N.Y.

[73] Assignee: Otis Elevator Company, Farmington, Conn.

[21] Appl. No.: 733,510

[22] Filed: Jul. 22, 1991

[51] Int. Cl.[5] ..... B66B 5/02

[52] U.S. Cl. ..... 187/108; 187/105

[58] Field of Search ..... 187/104, 109, 108, 105

[56] References Cited

U.S. PATENT DOCUMENTS 4,308,936 1/1982 Caputo et al. ..... 187/104

4,923,055 5/1990 Holland ..... 187/109

OTHER PUBLICATIONS

Lubomir Janovsky "Elevator Mechanical Design Principles and Concepts" Ellis Horwood Limited, England (1987) (Janovsky).

R. S. Phillips, Electric Lifts: A Manual on the Current Practice in the Design, Installation Working, and Maintenance of Lifts, 3rd Edition Sir Isaac & Sons, Ltd., London (1951) (Phillips).

*Primary Examiner*—Todd E. DeBoer

*Attorney, Agent, or Firm*—William W. Jones

[57] ABSTRACT

The governor rope on an elevator is provided with an auxiliary brake which is a fail-safe brake and which operates to stop movement of the governor rope when the elevator car moves away from a landing with its doors open. The brake includes two rope gripper jaws in the machine room beneath the governor sheave, which jaws are held away from the governor rope by a solenoid so long as power is supplied to energize the solenoid. When the power supply to the solenoid is interrupted, the jaws are released to fall by gravity toward each other to grip the governor rope. The car emergency brakes are thus tripped and movement of the car stops. The brake may also be provided to control the counterweight governor rope.

1 Claim, 3 Drawing Sheets

ELEVATOR GOVERNOR ROPE RESTRAINT WHEN ELEVATOR CAR MOVES WITH CAR DOORS OPEN

DESCRIPTION

1. Technical Field

This invention relates to an elevator safety system, and more particularly to a fail-safe brake which will grip the governor rope when the car moves away from a landing with its doors open. The fail-safe brake is an adjunct to the normal governor rope overspeed brake. Both the car and counterweight governors are provided with the brake of this invention.

2. Background Art

Elevator cars are provided with emergency brakes which can be tripped to seize the elevator guide rails in an emergency situation to stop movement of the car. The emergency brakes are connected to a governor system which monitors car movement, and which will trip the emergency brakes in an emergency situation. A typical elevator governor system includes a governor cable which is attached at one end to the top of the elevator car, and at the other end to the bottom of the car. The governor cable will be operably connected to the emergency brakes on the car. Governor sheaves are positioned in the machine room and in the hoistway pit and the governor cable is reeved over both of the governor sheaves. The sheave in the machine room is typically operably connected to a centrifugal or centripetal device which spins at speeds that are proportional to the speed of rotation of the machine room governor sheave. A mechanical connection is made between the spinning device and governor rope brake blocks, whereby the governor rope brake blocks will be tripped to seize the governor rope when the spinning device exceeds a preset rotational speed. The emergency systems of the prior art are thus overspeed safety devices which operate only in case of car and/or counterweight overspeed.

U.S. Pat. No. 4,923,055 granted May 8, 1990 to G. A. Holland discloses a safety mechanism for preventing unintended motion in traction elevators. The Holland mechanism is a fail-safe mechanism which requires use of a special rope sheave having appropriately spaced radial bosses on the sheave, which will trip a solenoid controlled lever should the sheave rotate while the solenoid is deenergized. A complex system of rotating and swinging links interconnect the tripped lever with the rope brake blocks. An abundance of safeties are included in the Holland mechanism to ensure that it does not accidentally trip.

DISCLOSURE OF THE INVENTION

This invention relates to a fail-safe, low-speed elevator safety device which will seize the elevator governor cable in the event that the elevator car moves away from a landing while its doors are open. The device can be associated with the car governor and also with the counterweight governor. The device of this invention will be used as an adjunct to the high speed governor safety, and will operate independently thereof. The device includes a pair of pivotal jaws which straddle the governor cable in the machine room floor beams. The jaws are gravity operated, and are operably interconnected by sector gears. A solenoid operated plunger engages a lever on one of the jaws to hold the jaws away from the governor cable so long as the solenoid is energized by the controller or battery from which it derives its power. Door and floor sensors are connected to the car controller for inputting door and car information to the controller. The controller in turn manipulates a switch in the circuit which supplies power to the solenoid. The switch will normally be closed to supply power to the solenoid, whereby the jaws will be normally held away from the governor cable. If the switch fails, power is also removed from the solenoids. The solenoid is energized directly from the same source as the controller. The battery need only be used during a power failure. If the door and car sensors signal door-open car movement to the controller, the latter will open the switch to deenergize the solenoid. The plunger will then be pushed away from the jaws allowing the latter to fall by gravity against the governor cable. When the governor cable is seized, the emergency brakes on the car or counterweight will be tripped whereby both elements will stop further movement. Stopping the counterweight stops upward movement of the car, and setting the emergency brakes on the car stops downward movement of the car. Thus, door-open movement of the car in either direction from the landing will be stopped. If power to the elevator system as a whole is interrupted, this emergency system will not be activated because the power to the solenoid can be derived from the battery.

It is therefore an object of this invention to provide a fail-safe device which operates to stop elevator car movement away from a landing when the car doors are open.

It is a further object of this invention to provide a device of the character described which operates under the influence of gravity.

It is another object of this invention to provide a device of the character described which operates on the governor cable independently of the overspeed governor cable tripper.

It is an additional object of this invention to provide a device of the character described which can stop upward or downward door-open car movement.

Another object of this invention is that the device can be applied to the system with a minimal intrusive effect since it does not require changing the existing governor.

These and other objects and advantages of the invention will become more readily apparent from the following detailed description of a preferred embodiment of the invention when taken in conjunction with the accompanying drawings, in which:

BEST MODE FOR CARRYING OUT THE INVENTION

Figure 1:
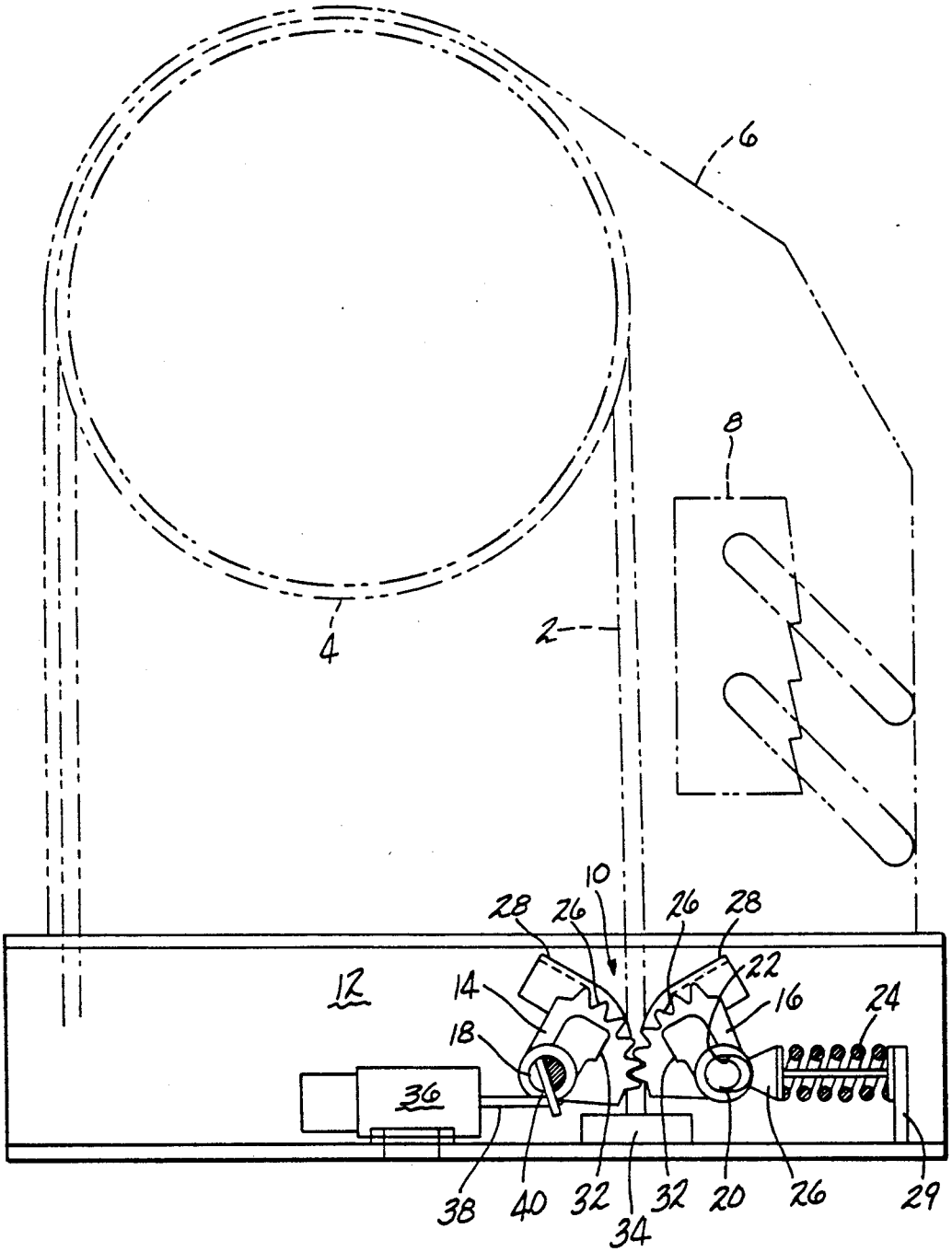
FIG. 1 is a fragmented elevational view of a preferred embodiment of the fail-safe device of this invention, with the governor sheave and cable being shown in phantom for clarity.

Referring now to FIG. 1, there is shown a preferred embodiment of the fail-safe device of this invention. In FIG. 1, the governor cable 2, sheave 4, governor sheave case 6, and conventional overspeed governor cable block 8 are all shown in phantom for purposes of highlighting and distinguishing the fail-safe device, denoted generally by the numeral 10, from the prior art governor components. The fail-safe device 10 is mounted on a beam 12 on the elevator machine room floor beneath the governor sheave case 6. A pair of swinging jaw members 14 and 16 include transverse pins 18 and 20, respectively. The pin 20 is received in an elongated opening 22 in the jaw 16 whereby the latter can move toward and away from the jaw 14. A spring 24 and plunger 26 are mounted on a plate 29 to bias the jaw pivot 20 toward the jaw 14. Each jaw 14 and 16 has a sector gear portion 26 and a cable seizing portion 28. The sector gears 26 intermesh so that motion imposed on one jaw will be transmitted to the other. Each of the jaws 14 and 16 has an integral pivot stop 32 which, as explained hereinafter, will impact a stop block 34 to limit the extent to which the jaws 14 and 16 can pivot downwardly. The spring 24 and stop block 34 act in conjunction to limit the amount of pressure that can be applied to the governor rope to prevent damaging it. A solenoid 36 is mounted on the beam 12 and includes a plunger 38 which engages a cam surface 40 on the jaw pin 18 to hold the jaw 14, and thus the jaw 16, in the positions shown in FIG. 1, away from the governor cable 2. Thus the governor cable 2 can move freely up and down between the cable seizing portions 28 of the jaws 14 and 16. So long as the solenoid 36 is energized, the plunger 38 will remain in its extended position, and movement of the governor cable 2 will be unimpeded. When power to the solenoid 36 is interrupted, the plunger 38 will retract, allowing the jaws 14 and 16 to pivot by gravity downwardly. The spring 24 causes the jaw 16 to move toward the jaw 14 and tighten against the governor cable 2. When the governor cable 2 is thus seized by the jaw portions 28, further cable movement is prevented.

Figure 2:
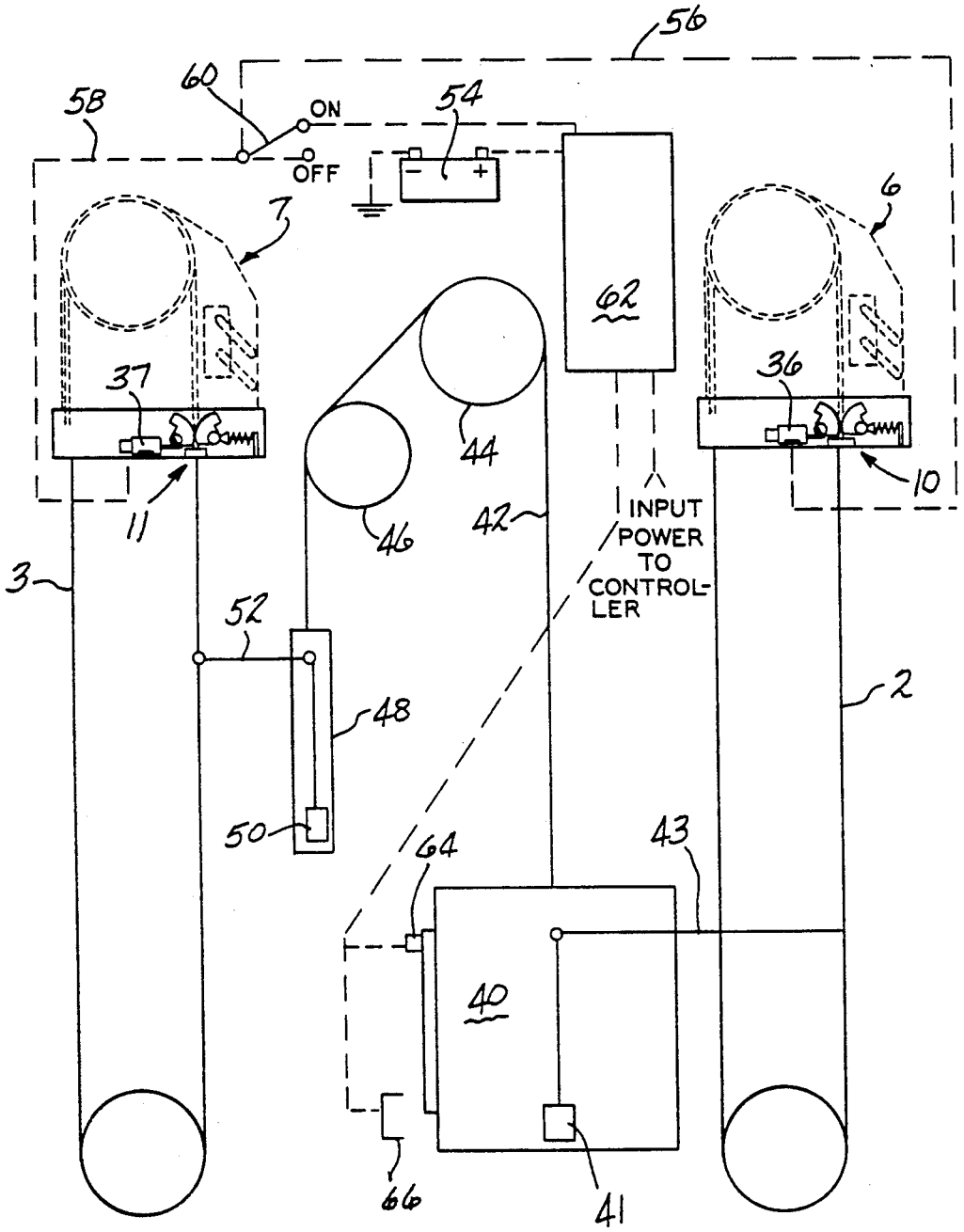
FIG. 2 is a schematic view of an elevator system equipped with the device of FIG. 1 at its car and counterweight governors.

Referring to FIG. 2, the elevator system in general is shown in a schematic format. The elevator car 40 is suspended from cables 42 which pass over sheaves 44 and 46 to a counterweight 48. The car 40 and counterweight 48 both move up and down in a hoistway on respective sets of guide rails (not shown) which are fastened to the hoistway walls. The car governor assembly 6 and a counterweight governor assembly 7 are shown, each with their respective fail-safe devices 10 and 11 formed in accordance with this invention. The counterweight governor cable 3 is connected to a counterweight safety brake assembly 50 via coupling 52; and similarly the car governor cable 2 is connected to a car safety brake assembly 41 via coupling 43. It will be understood that the counterweight safety 50 and the car safety 41, when actuated, will seize the counterweight and car guide rails respectively to stop movement of both the counterweight 48 and car 40.

Power to the fail-safe solenoids 36 and 37 is provided by the controller 62 through lines 56 and 58. A switch 60 operated by the elevator controller 62 can be selectively closed and opened to supply or interrupt power from the controller 62 to the solenoids 36 and 37. Normally the switch 60 will be held on with power so that the solenoids 36 and 37 remain energized. The controller 62 is connected to and receives input from door sensors 64 and the car 40, and floor sensors 66 at each landing in the hoistway. The door sensors 64 tell the controller 62 whether the car doors are open or closed, and the floor sensors 66 tell the controller 62 where the car 40 is relative to the hoistway landing. So long as the car doors remain open and the car 40 remains properly positioned at the landing, as verified by the sensors 64 and 66, the controller 62 will keep the switch 60 on and keep the solenoids 36 and 37 energized. When the sensors 64 and 66 signal door-open movement away from the landing, the controller 62 will close the switch 60 to the position shown in dashed lines in FIG. 2, and the solenoids 36 and 37 will be deenergized. This will cause the fail-safe jaws to seize the governor ropes 2 and 3 whereby further movement of the car 40 and counterweight 48 will result in tripping the emergency brakes 41 and 50. In the event of power failure, the battery 54 will monitor the sensors and power the solenoid.

Figure 3:
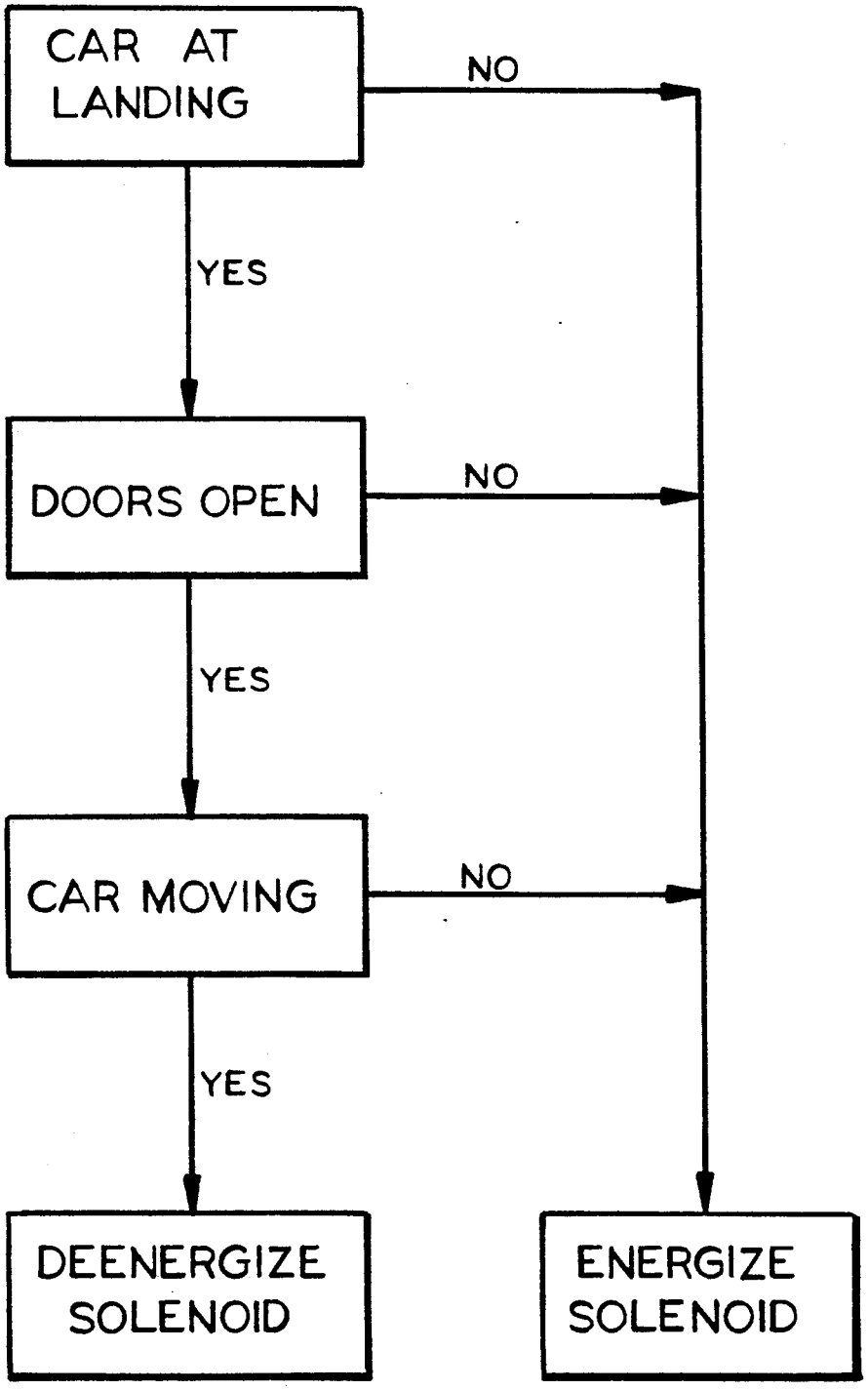
FIG. 3 is a software flowchart for the emergency brake tripper of this invention.

FIG. 3 illustrates the constant monitoring of the car and doors undertaken by the controller software, and also the actions taken by the controller based on the incoming car and door information.

It will be readily appreciated that the fail-safe system of this invention will provide safe stoppage of the elevator car and counterweight in the event that the car should move away from a landing with the car doors open. The car will be stopped safely no matter which direction it is moving. The system, being a fail-safe system that requires loss of power to the operating solenoids in order to trip, is provided with a battery power supply to ensure that it will not be tripped if, for some reason, electrical power to the building, or parts thereof, is lost. The system is auxiliary to the over speed car safety system and will not interfere with operation thereof.

Since many changes and variations of the disclosed embodiment of the invention may be made without departing from the inventive concept, it is not intended to limit the invention otherwise than as required by the appended claims.

What is claimed is:

1. An elevator safety system for stopping movement of an elevator governor rope upon movement of an elevator cab away from a landing with the cab doors open, said system comprising:

a) first means for detecting the position of the cab relative to the landings;

b) second means for detecting the position of the cab doors;

c) controller means connected to said first and second means for receiving signals from the latter, said controller means being operable to emit a stop signal when door-open cab movement away from a loading is detected;

d) jaw means straddling said governor rope and movable between a rope-grasping position and a rope-free position, said jaw means comprising a pair of pivotal jaws, one of which is disposed on each side of said governor rope; spring means biasing one of said jaws toward the other; said jaws including intermeshed toothed portions for providing coordinated closing movement of said jaws onto the governor rope;

e) catch means for engaging the other of said jaws to hold said jaw means in said rope-free position whereby said governor rope is free to move unimpededly between said jaw means; and f) means connected to said controller means for disabling said catch means in response to said stop signal whereby said jaws automatically move to said rope-grasping position to stop further movement of the governor rope.

* * * * *